US011839271B2

(12) United States Patent
Inukai et al.

(10) Patent No.: US 11,839,271 B2
(45) Date of Patent: Dec. 12, 2023

(54) SLIDE FASTENER

(71) Applicant: YKK Corporation, Tokyo (JP)

(72) Inventors: Takayuki Inukai, Kurobe (JP); Aoi Takekawa, Kurobe (JP); Yutian Long, Kurobe (JP); Yuko Fukuda, Kurobe (JP); Mitsuo Tsuzuyama, Kurobe (JP)

(73) Assignee: YKK Corporation

( * ) Notice: Subject to any disclaimer, the term of this patent is extended or adjusted under 35 U.S.C. 154(b) by 11 days.

(21) Appl. No.: 17/768,413

(22) PCT Filed: Nov. 29, 2019

(86) PCT No.: PCT/JP2019/046922
§ 371 (c)(1),
(2) Date: Apr. 12, 2022

(87) PCT Pub. No.: WO2021/106226
PCT Pub. Date: Jun. 3, 2021

(65) Prior Publication Data
US 2023/0062710 A1 Mar. 2, 2023

(51) Int. Cl.
*A44B 19/26* (2006.01)

(52) U.S. Cl.
CPC ..... *A44B 19/265* (2013.01)

(58) Field of Classification Search
CPC ..... A44B 19/265; A44B 19/02
See application file for complete search history.

(56) References Cited

U.S. PATENT DOCUMENTS 1,609,487 A * 12/1926 Marinsky ..... A44B 19/02 24/407
1,739,500 A * 12/1929 Blair ..... A44B 19/02 24/406
1,836,958 A * 12/1931 Dalton ..... A44B 19/04 24/406
2,867,879 A * 1/1959 Urban ..... A44B 19/02 24/411
3,973,300 A * 8/1976 Takamatsu ..... A44B 19/265 24/426
5,497,535 A * 3/1996 Kloor ..... A44B 19/265 24/426

(Continued)

FOREIGN PATENT DOCUMENTS

JP S5153765 Y2 12/1976
JP S55166510 U 11/1980
JP S5778804 A 5/1982

(Continued)

OTHER PUBLICATIONS

Inukai, Takayuki; International Search Report and Written Opinion for PCT/JP2019/046922, filed Nov. 29, 2019, dated Feb. 4, 2020, 21 pgs.

(Continued)

*Primary Examiner* — Robert Sandy
*Assistant Examiner* — Louis A Mercado
(74) *Attorney, Agent, or Firm* — Taylor English Duma LLP

(57) ABSTRACT

In at least a part of a movable range of a slider, a slider upper portion is positioned adjacent to a wall upper portion, and a slider lower portion is positioned adjacent to a wall lower portion. This prevents jamming of a cloth in the slider at both sides of the tape upper and lower surfaces.

19 Claims, 7 Drawing Sheets

(56) References Cited

U.S. PATENT DOCUMENTS

| | | | | |
|---|---|---|---|---|
| 10,575,600 | B2 * | 3/2020 | Zhou | A44B 19/34 |
| 2015/0201717 | A1 * | 7/2015 | Bliss | A44B 19/34<br>24/418 |

FOREIGN PATENT DOCUMENTS

| | | | |
|---|---|---|---|
| JP | S60105409 | U | 7/1985 |
| JP | 2005160785 | A | 6/2005 |
| JP | 5403639 | B2 | 1/2014 |

OTHER PUBLICATIONS

Inukai, Takayuki; International Preliminary Report on Patentability for PCT/JP2019/046922, filed Nov. 29, 2019, dated Jun. 9, 2022, 10 pgs.

* cited by examiner

[Fig. 1]
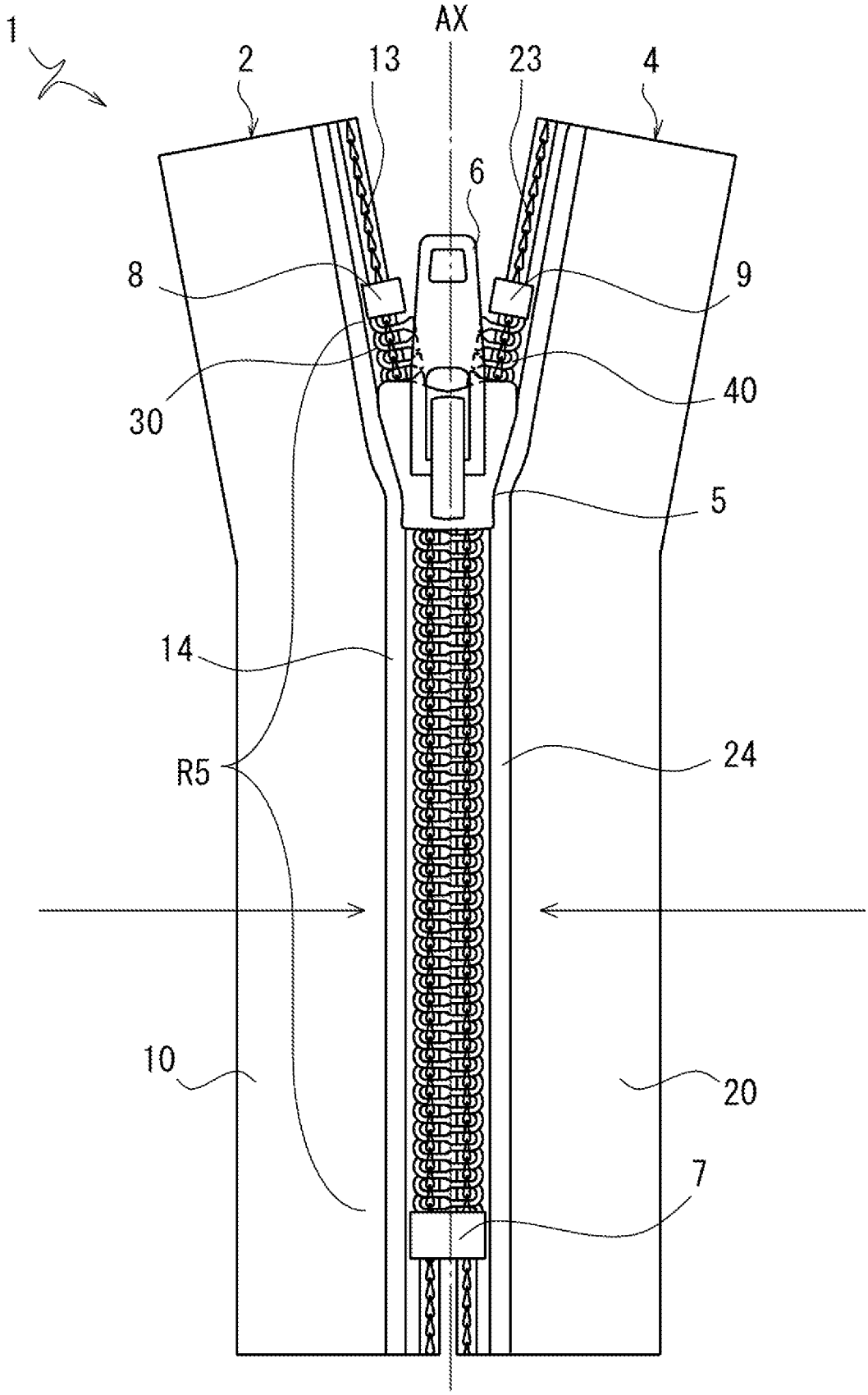

[Fig. 2]
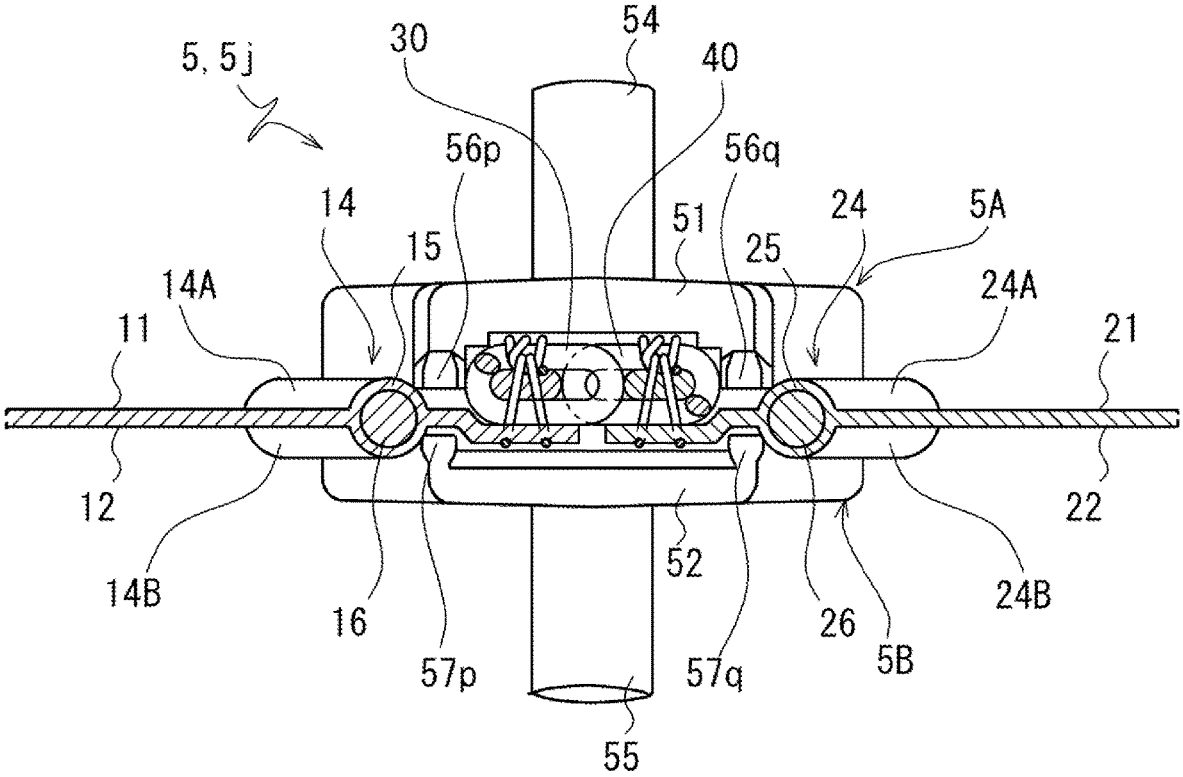
[Fig. 3]
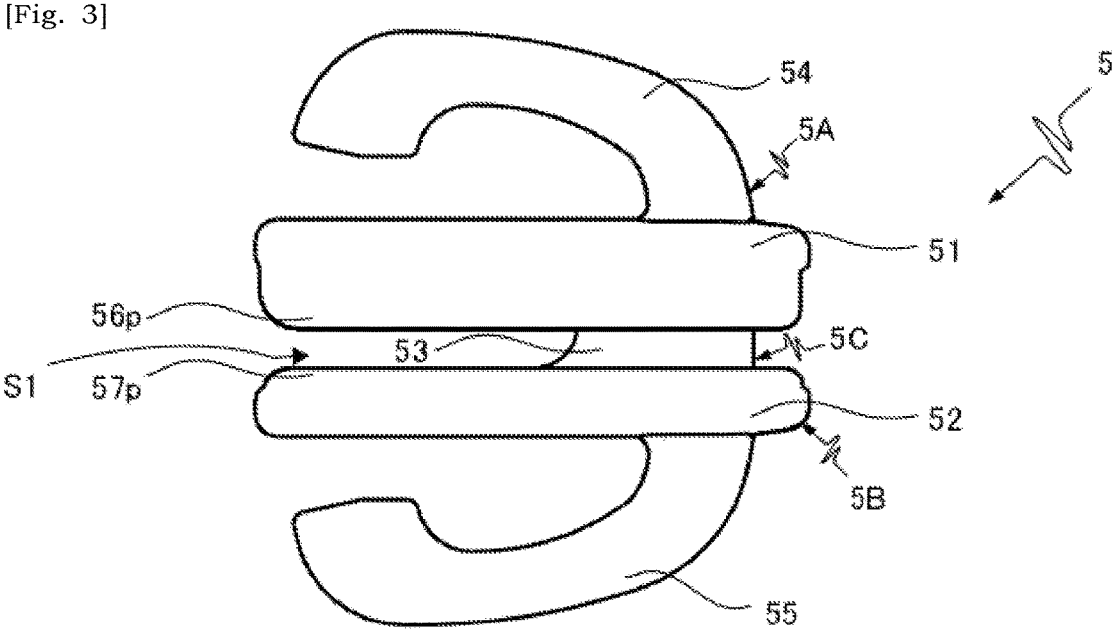

[Fig. 4]
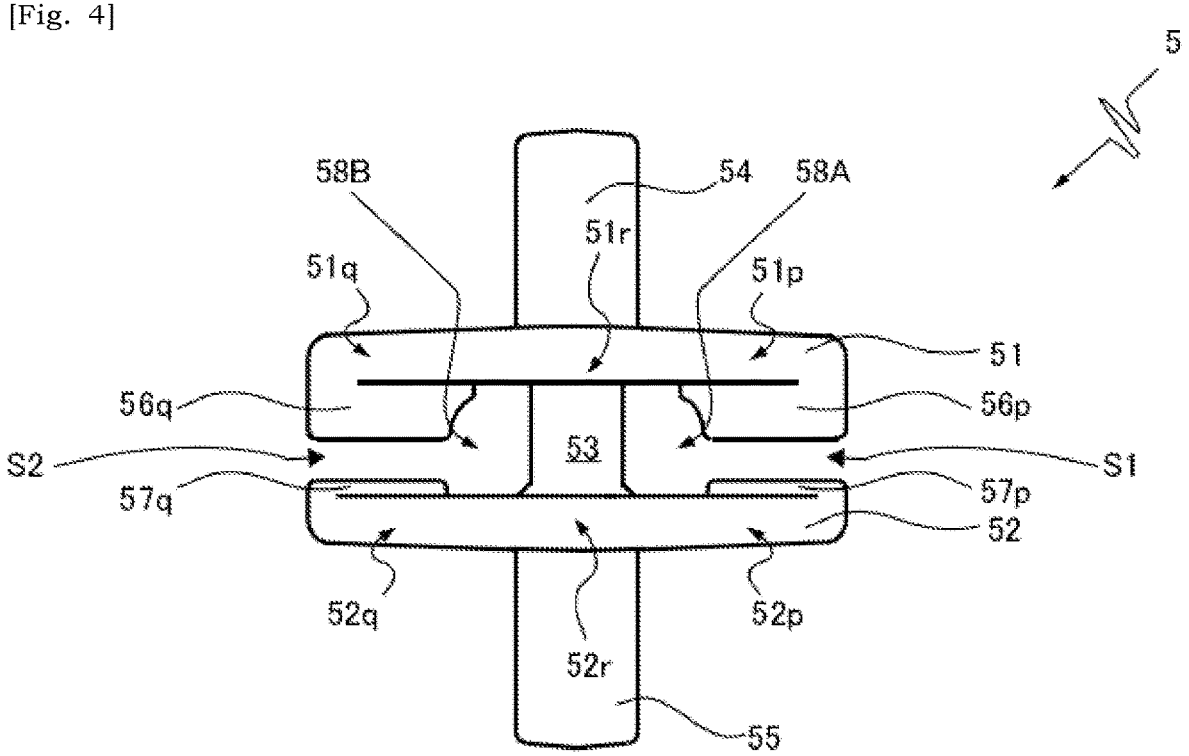
[Fig. 5]
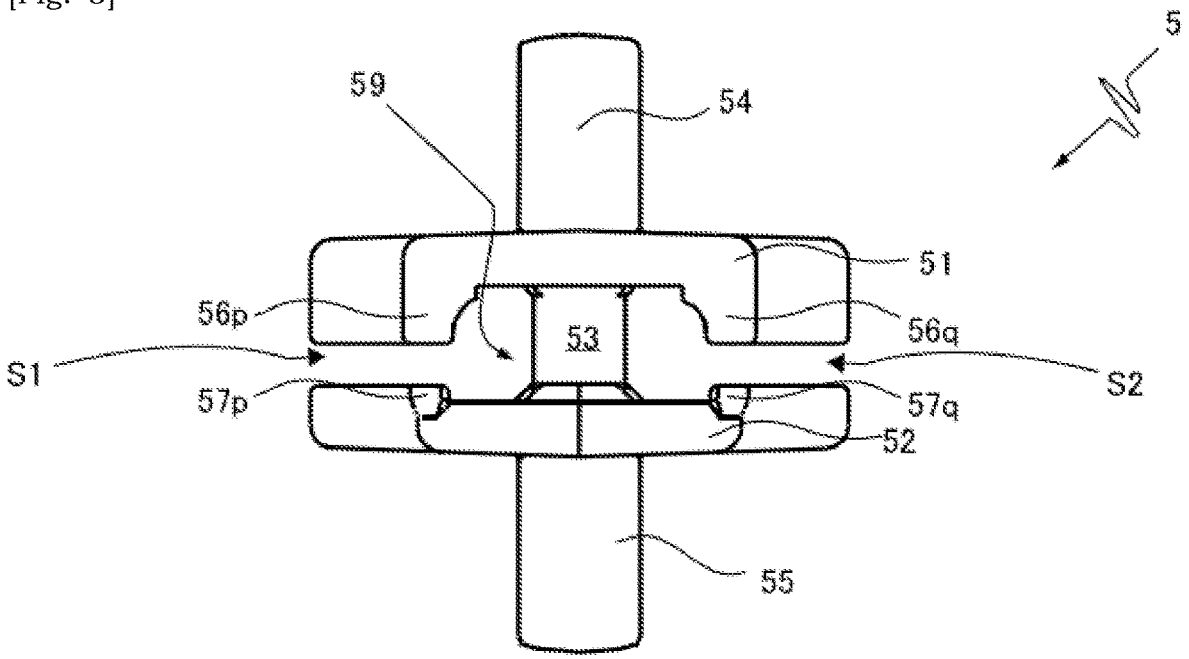

[Fig. 6]
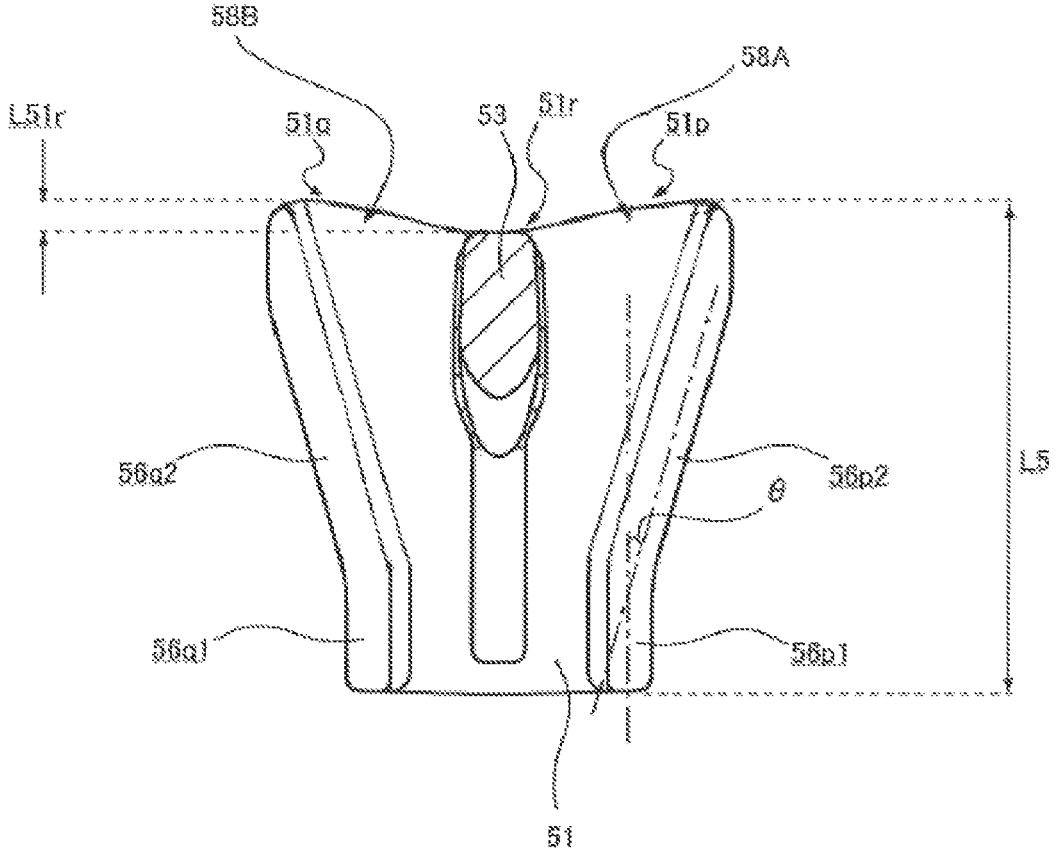

[Fig. 7]
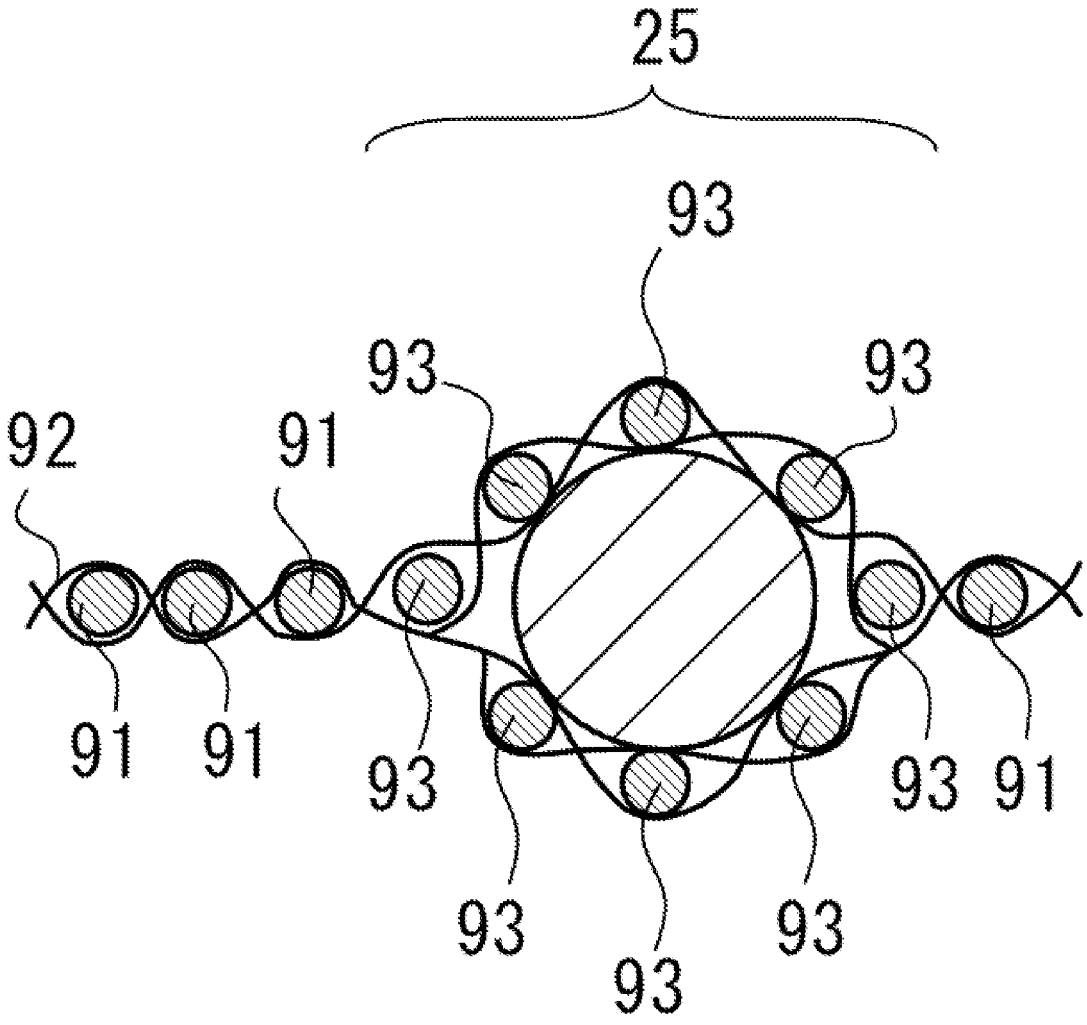

[Fig. 8]
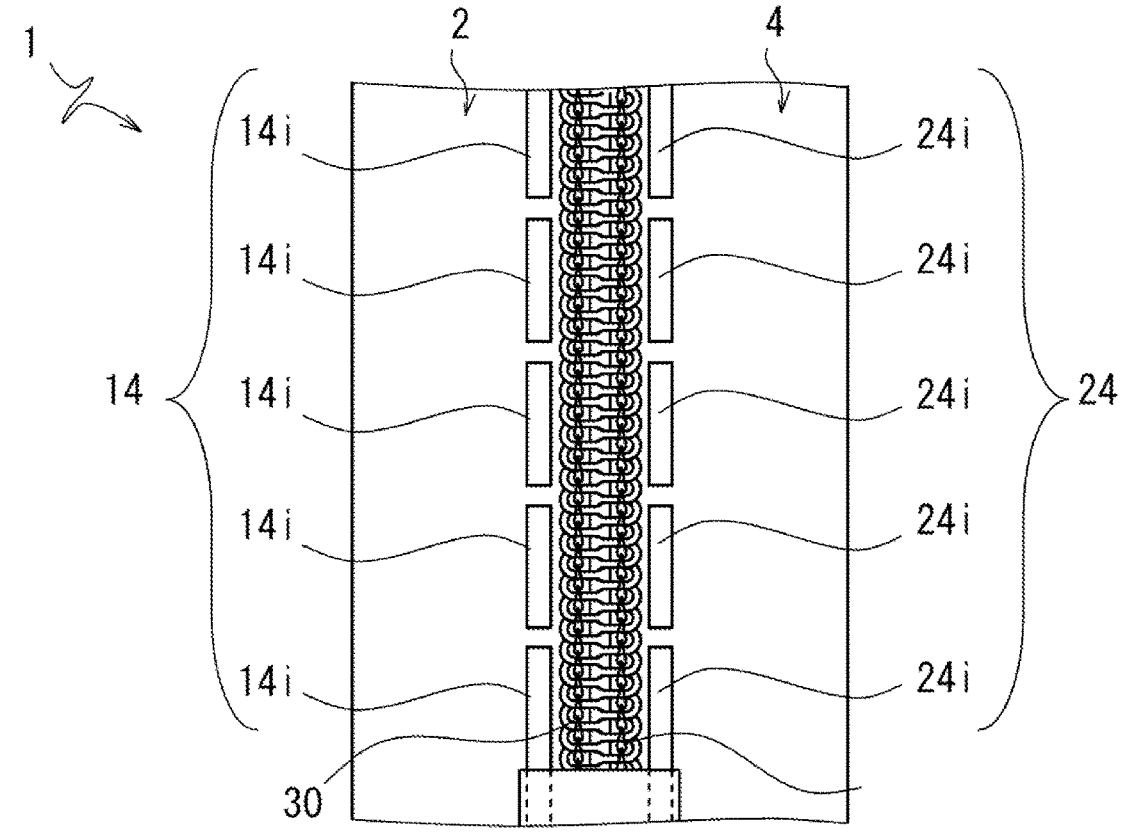
[Fig. 9]
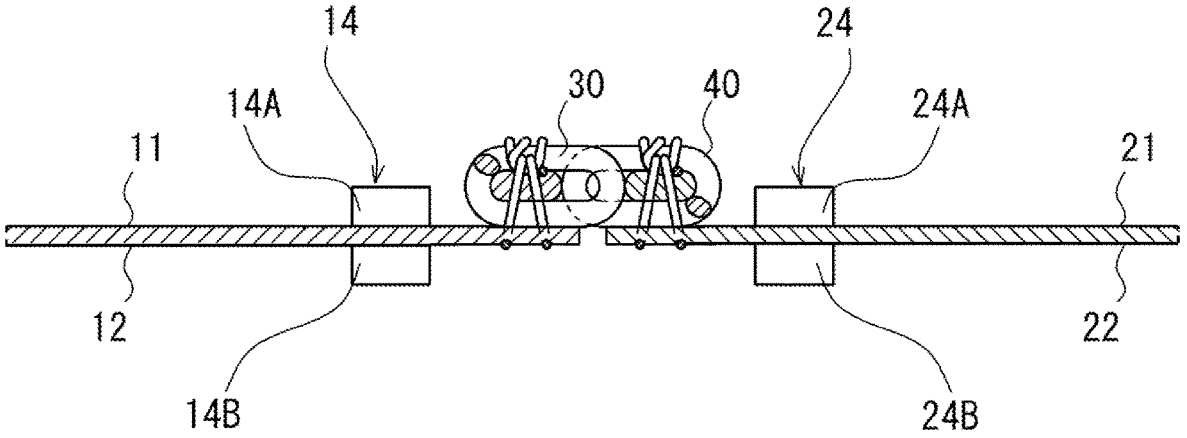

[Fig. 10]
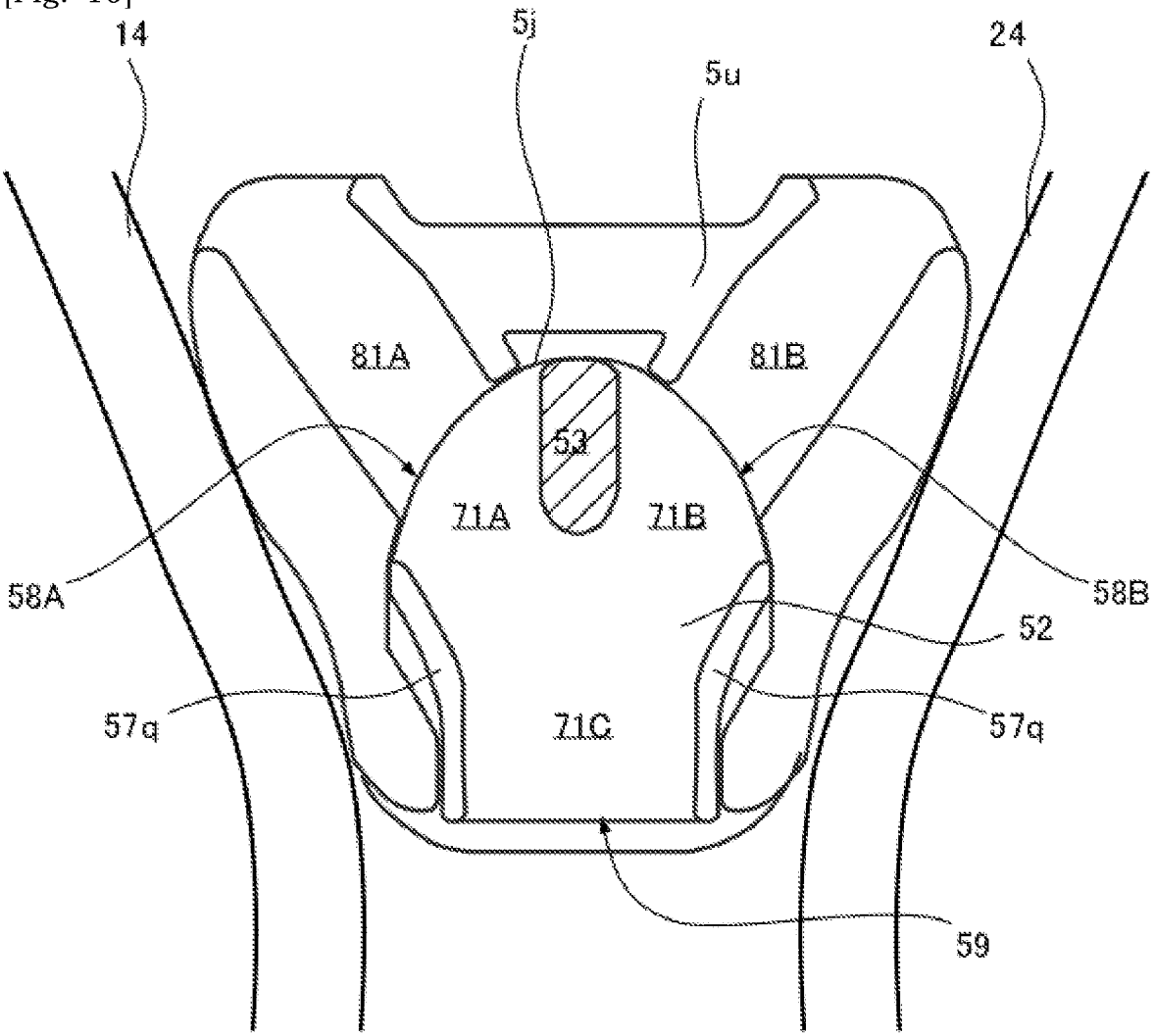

SLIDE FASTENER

TECHNICAL FIELD

The present disclosure is related to slide fasteners.

BACKGROUND ART

Patent literature 1 discloses that an elongated protrusion is arranged on an inner surface of a fastener tape to prevent jamming of a lining in a slider. Sewing or bonding of a cord/linear member made of synthetic resin, or thermal bonding of a linear member made of synthetic resin are described as exemplary ways of forming the elongated protrusion. FIG. 3 of the literature illustrates an embodiment where an elongated protrusion is formed by partially laminating a fastener tape.

Patent literature 2 discloses that a slider is provided with a V-shaped or U-shaped recess so that jamming of a cloth is prevented.

Patent literature 3 discloses that a "plastically deformable" core is inserted into an inside of a tubular woven portion for a purpose of improving a shape-retaining characteristic of the slide fastener (See claim 10, para. 0015 and FIG. 3), not directly related to a technical problem of jamming of a cloth though.

CITATION LIST

Patent Literature

[Patent literature 1] Japanese Utility-model Application Laid-open No. 60-105409

[Patent literature 2] Japanese Patent Application Laid-open No. 2005-160785

[Patent literature 3] Japanese Patent No. 5403639

SUMMARY

Technical Problem

In a case where an elongated protrusion is provided only at an inner side of a fastener tape as disclosed in Patent literature 1, there is a possibility that jamming of a cloth is not prevented because, when a slide fastener is subjected to a deformation such as bending or twisting, the elongated protrusion would also be deformed. In order to cope with such a problem, one may consider increasing rigidity of the elongated protrusion, but this is not a practical approach as the elongated protrusion can be unacceptably large at the inner side of the fastener tape. Also, it is first of all not possible to prevent jamming of a cloth in a slider at the outer side of fastener tape even if the elongated protrusion is provided at the inner side of the fastener tape as disclosed in the patent literature 1.

The present inventors have newly identified a technical problem to prevent jamming of a cloth in a slider at both sides of a fastener tape while suppressing a bulkiness of a wall that is configured to prevent jamming of a cloth in a slider.

Solution to Problem

A slide fastener according to an aspect of the present disclosure includes: a pair of fastener stringers including a fastener tape and a fastener element arranged on a side-edge of the fastener tape, the fastener tape having tape upper and lower surfaces which define a tape thickness; and a slider to be moved to open or close the pair of fastener stringers, the slider including a slider upper portion arranged at the same side as the tape upper surface, a slider lower portion arranged at the same side as the tape lower surface, and a connecting portion connecting the slider upper portion and the slider lower portion. At least one fastener tape is provided with a wall configured to prevent jamming of a cloth, the wall being arranged to be spaced apart from the fastener element. The wall includes a wall upper portion arranged at the same side as the tape upper surface and protruding from the tape upper surface, and a wall lower portion arranged at the same side as the tape lower surface and protruding from the tape lower surface. In at least a part of a movable range of the slider, the slider upper portion is positioned adjacent to the wall upper portion and the slider lower portion is positioned adjacent to the wall lower portion so that jamming of a cloth in the slider is prevented at both sides of the tape upper and lower surfaces.

In some embodiments, the wall upper portion is arranged to touch the slider upper portion at least partially and/or the wall lower portion is arranged to touch the slider lower portion at least partially.

In some embodiments, a distance between the slider upper portion and the wall is equal to or less than 1 times a width of the fastener element in the same direction as that distance; and/or a distance between the slider lower portion and the wall is equal to or less than 1 times a width of the fastener element in the same direction as said distance.

In some embodiments, the slider has a slit for passing the fastener tape, the slit being defined between opposed portions of the slider upper portion and the slider lower portion, and a thickness of the wall in an Up-Down direction is in a range between 0.75 times and 5 times a width of the slit in the Up-Down direction.

In some embodiments, the thickness of the wall in the Up-Down direction is in a range between 1 times and 5 times the width of the slit in the Up-Down direction.

In some embodiments, the wall is flexible. In some embodiments, the wall includes a tubular structure of the fastener tape and a core enclosed in the tubular structure. In some embodiments, the core is flexible. In some embodiments, the tubular structure includes a warp thread having a thickness greater than a thickness of a weft thread in the fastener tape.

In some embodiments, the wall is a resin or metal part attached to the fastener tape.

In some embodiments, the slider includes a slider body including an upper wing, a lower wing, and a connecting post connecting the upper wing and the lower wing, the upper and lower wings being arranged to face one another, each of the upper wing and the lower wing has a front end in which left and right shoulders extends along a Left-Right direction and a central recess is recessed rearward at a position between the left and right shoulders, the Left-Right direction being orthogonal to a movement direction of the slider body.

In some embodiments, the upper wing has a flange protruding toward the lower wing to define a slit for passing the fastener tape, and a front end of the flange is connected to the front end of the upper wing.

Advantageous Effects of Invention

According to an aspect of the present disclosure, jamming of a cloth in a slider can be prevented at both sides of a fastener tape while suppressing a bulkiness of a wall that is configured to prevent jamming of a cloth in a slider.

BRIEF DESCRIPTION OF DRAWINGS

FIG. 1 is a schematic top view of a closed slide fastener according to an aspect of the present disclosure.

FIG. 2 is a schematic cross-sectional view of a slide fastener shown in FIG. 1, illustrating a slider viewed from a rear side thereof.

FIG. 3 is a side view of a slider according to an aspect of the present disclosure.

FIG. 4 is a front side view of a slider shown in FIG. 3.

FIG. 5 is a rear side view of a slide shown in FIG. 3.

FIG. 6 is a cross-sectional view of a slider shown in FIG. 3, illustrating an inner surface of an upper wing.

FIG. 7 is a view depicting a schematic configuration of a wall according to an aspect of the present disclosure.

FIG. 8 is a schematic partial top view of a slide fastener according to another aspect of the present disclosure.

FIG. 9 is a schematic cross-sectional view of a slide fastener shown in FIG. 8.

FIG. 10 is a view depicting a schematic configuration of a slider according to another aspect of the present disclosure, a cover separable in Up-Down direction being attached to a slider body.

DESCRIPTION OF EMBODIMENTS

Hereinafter, various embodiments and features will be described with reference to FIGS. 1 to 10. A skilled person would be able to combine respective embodiments and/or respective features without requiring excess descriptions and would appreciate synergistic effects of such combinations. Overlapping descriptions among the embodiments would be basically omitted. Referenced drawings are mainly for describing inventions and may possibly be simplified for the sake of convenience of illustration. Individual features will be understood as a universal feature which is not only effective to slide fasteners disclosed in the present specification but also effective to other various slide fasteners not disclosed in the present specification.

Slide fastener 1 is an elongated web having a lengthwise direction, a crosswise direction, and a thickness direction. The slide fastener 1 includes a pair of fastener stringers 2,4, and a slider 5 to be moved to open or close the pair of fastener stringers 2,4. The fastener stringer 2 is a component in which a fastener element 30 is secured to a side-edge 13 of a belt-like fastener tape 10 along the lengthwise direction. Similarly, the fastener stringer 4 is a component in which a fastener element 40 is secured to a side-edge 23 of a belt-like fastener tape 20 along the lengthwise direction. The slider 5 is engaged with the fastener elements 30 and 40 in a slidable fashion. The slider 5 moves frontward so that the pair of fastener stringers 2,4 are closed (the fastener elements 30,40 are engaged), and the slider 5 moves rearward so that the pair of fastener stringers 2,4 are separated (the fastener elements 30,40 are disengaged).

In the present specification, Up-Down direction is equal to a thickness direction of the slide fastener 1. Front-Rear direction is orthogonal to the Up-Down direction, and is equal to the lengthwise direction of the slide fastener 1 and the movement direction of the slider 5. Left-Right direction is orthogonal to the Up-Down direction and the Front-Rear direction and is equal to the crosswise direction of the slide fastener 1.

The fastener tape 10,20 is, for example, a woven fabric or knitted fabric or combination thereof and is an elongated belt-like flexible fabric. The fastener tape 10,20 is made of plural tape structures. In a case where the fastener tape 10,20 is a woven fabric, a tape structure such as a plain weave, twill weave, warp rib weave, or hollow weave (double weave) is configured by plural warp threads and one or plural weft threads. In a case where the fastener tape 10,20 is a knitted fabric, a tape structure is configured by a warp knitted structure such as a chain weave, tricot weave and satin weave. If required, a core thread is secured to the side-edge 13,23 of the fastener tape 10,20 along the lengthwise direction, thereby increasing the attachment strength of the fastener element 30,40 to the fastener tape 10,20, for example. Structures, configurations and thickness of the fastener tape can be variously determined by a skilled person in the art.

The fastener tape 10 has a tape thickness defined by a distance between a tape upper surface 11 and a tape lower surface 12 illustrated in FIG. 2. The fastener tape 20 has a tape thickness defined by a distance between a tape upper surface 21 and a tape lower surface 22 illustrated in FIG. 2.

The slider 5 has a slider upper portion 5A arranged at the same side as the tape upper surface 11,21 of the fastener tape 10,20, a slider lower portion 5B arranged at the same side as the tape lower surface 12,22 of the fastener tape 10,20, and a connecting portion 5C connecting the slider upper portion 5A and the slider lower portion 5B. The slider 5 is further provided with slits S1,S2, defined between opposed portions of the slider upper and lower portions 5A and 5B, for permitting the fastener tape 10,20 to pass there-through. Width of the slit S1,S2 in the Up-Down direction (i.e. Slit-width) is equal to a distance between a portion (e.g. a flange) of the slider upper portion 5A and a portion (e.g. a flange) of the slider lower portion 5B which define the slit S1,S2. Typically, the width of the slit S1,S2 in the Up-Down direction (i.e. the slit-width) is greater than a thickness, in the Up-Down direction, of a portion of the fastener tape 10,20 provided in the slit S1,S2, but should not be limited to this. The opposed portions of the slider top and lower portions 5A and 5B, defining the slit S1,S2, may be in contact with the respective upper and lower surfaces 11,21 and 12,22 of the fastener tape 10,20 when the slider 5 moves frontward or rearward.

For example, as shown in FIGS. 2-6, the slider 5 is configured by a single component of a slider body 5*j* (with an optional pull tab 6 attached thereto). The slider body 5*j* has upper and lower wings 51 and 52 arranged in the Up-Down direction to face each other, a connecting post 53 connecting the upper wing 51 and the lower wing 52, a pull-attachment column 54 arranged on the upper wing 51, and a pull-attachment column 55 arranged on the lower wing 52. The slider upper portion 5A is configured by the upper wing 51 and the pull-attachment column 54. The slider lower portion 5B is configured by the lower wing 52 and the pull-attachment column 55. The connecting portion 5C is configured by the connecting post 53. Note that, FIGS. 3-5 shows a condition before the pull-attachment columns 54,55 are plastically deformed.

Y-shaped element passage is formed in the slider body 5*j* which is bifurcated by the connecting post 53. A pair of front openings 58A,58B are arranged at the left and right sides of the connecting post 53. A rear opening 59 is arranged at the opposite side of the front openings 58A,58B. The front openings 58A,58B are arranged to sandwich the connecting post 53 in the Left-Right direction orthogonal to the movement direction of the slider body 5*j*. Separated fastener elements 30,40 move into and out from the slider body 5*j* via the front openings 58A,58B. Engaged fastener elements 30,40 move into and out from the slider body 5*j* via the rear opening 59.

The upper wing 51 is provided with flanges 56*p*,56*q* which are protruded toward the lower wing 52 so as to define respective slits S1,S2 for passing the fastener tape 10,20. Similarly, the lower wing 52 is provided with flanges 57*p*,57*q* protruded toward the upper wing 51 so as to define respective slits S1,S2 for passing the fastener tape 10,20. The slit S1,S2 extends in the Front-Rear direction to communicate the front opening 58A or 58B and the rear opening 59. Passage for the left or right fastener element 30,40 is provided between the connecting post 53 and a respective one of the flanges 56*p*,56*q*. Passage for the engaged left and right fastener elements 30,40 is provided in a space rearward of the connecting post 53 and between the flanges 56*p*,56*q*. The height of the protruded flange 56*p*,56*q* is greater than the height of the protruded flange 57*p*,57*q* in the illustrated example, but a case is envisioned where they are at the same height.

The slit 51 has a slit width S10 that corresponds to a distance between the flange 56*p* of the upper wing 51 and the flange 57*p* of the lower wing 52 in the slider 5. In a case where the slider 5 is not provided with a flange, the slit width S10 corresponds to a distance between the slider upper portion 5A and the slider lower portion 5B of a space in the slider 5 where the fastener tape 10 passes through. Similarly, the slit S2 has a slit width S20 which corresponds to a distance between the flange 56*q* of the upper wing 51 and the flange 57*q* of the lower wing 52 in the slider 5. In a case where the slider 5 is not provided with a flange, the slit width S20 corresponds to a distance between the slider upper portion 5A and the slider lower portion 5B of a space in the slider 5 where the fastener tape 20 passes through. For example, the slit width S10,S20 is greater than a minimum value of the tape thickness of the fastener tape 10,20.

In the present embodiment, the fastener tape 10 has a wall 14 arranged to be spaced apart from the fastener element 30 with an interspace. Similarly, the fastener tape 20 has a wall 24 arranged to be spaced apart from the fastener element 40 with an interspace. The above-described interspace, i.e. a distance between an edge of the fastener element 30 at the side of the wall 14 and an edge of the wall 14 at the side of the fastener element 30 is equal to or less than a width of the fastener element 30 in the Left-Right direction. The thickness of the wall 14 is greater than the tape-thickness of the other portion of the fastener tape 10. The thickness of the wall 24 is greater than the tape-thickness of the other portion of the fastener tape 20. The wall 14,24 has a wall upper portion 14A,24A protruding from the tape upper surface 11,21 in the thickness direction of the fastener tape 10,20, and a wall lower portion 14B,24B protruding from the tape lower surface 12,22 in the thickness direction of the fastener tape 10,20. The walls 14,24 are provided to prevent jamming of a cloth.

The thickness of the wall 14,24 in the Up-Down direction may be in a range between 0.75 times and 5 times the width of the slit S1,S2 in the Up-Down direction (Slit width S10,S20). Preferably, the thickness of the wall 14,24 in the Up-Down direction is greater than the slit width S10,S20. That is, the thickness of the wall 14,24 in the Up-Down direction is in a range between 1 times and 5 times the width of the slit S1,S2 in the Up-Down direction (the slit width S10,S20). Such a configuration allows further facilitation of preventing jamming of a cloth. Furthermore, preferably, the thickness of the wall 14,24 in the Up-Down direction is twice the width of the slit S1,S2 in the Up-Down direction (the slit width S10,S20). Such a configuration allows facilitation of preventing jamming of a cloth without any change on a sliding property of the slider 5.

As shown in FIG. 2, the wall 14,24 has a tubular structure 15,25 of the fastener tape 10,20 and a core 16,26 enclosed in this tubular structure 15,25. FIG. 7 is a schematic cross-sectional view of the fastener tape 10,20, depicting a condition of plural warp threads relative to a a weft thread 92. The tubular structure 15,25 includes plural warp threads 93 per the weft thread 92. The warp threads 93 are arranged to surround the core 16,26 in its periphery. The tubular structure 15,25 is based on a hollow weave (double weave). Note that a method of forming a hollow weave is known for skilled ones in the art, and thus detail descriptions will be omitted. The wall 14,24 is configured to include the weft thread and the warp threads likewise the other portion of the fastener tape 10,20, thus suppressing that more attention is to be paid to the wall 14,24 when the tape upper surface 11,21 or the tape lower surface 12,22 is looked at.

The wall 14,24 is formed simultaneously when the fastener tape 10,20 is woven, allowing precise positioning of the wall 14,24 and omission of additional step of attaching the wall 14,24 onto the fastener tape 10,20. Moreover, there is no risk of removal of the wall 14,24 off the fastener tape 10,20.

The wall 14,24 may be flexible, preferably. In such a case, even if the slider 5 slides while touching the wall 14,24, not all stress is applied from the slider 5 to the wall 14,24, thus a functionality of preventing jamming of a cloth is obtained without sacrificing a sliding property. Also, it is avoided or suppressed that the wall 14,24 is worn due to the contact between the slider 5 and the wall 14,24.

The thickness of the warp thread 93 in the tubular structure 15,25 of the wall 14,24 is greater than the thickness of the warp thread 91 in the other portion. The thickness of the warp thread 93 in the tubular structure 15,25 of the wall 14,24 is greater than (e.g. 3 times) the thickness of the weft thread 92. The core 16,26 of the wall 14,24 is a knitted cord and includes a bundle of threads covered by skin threads in its periphery. The strength of the core 16,26 is greater than the strength of a core thread arranged on a side-edge 13,23 of the fastener tape 10,20 along the lengthwise direction. The core thread is a twisted cord and formed by bundling and twisting plural threads. The core thread can contract in a given extent. Warp threads in a hollow weave (double weave) around this core thread are the same as and have the same thickness as the weft threads. Note that, the thickness of the warp threads used in the wall 14,24 may be equal to or greater than 3 times the thickness of the weft thread in the above descriptions but should not be limited to this. In a case where the core thread of the wall is thickened, the thickness of the warp thread used for the wall may be equal to the thickness of the weft thread. Note that, the core 16, 26 has been described as a knitted cord, but should not be limited to this and can be a metal wire or resin wire.

The fastener element 30,40 is, for example, a coil element which is a mono-filament wound in helix but can be configured by arrangement of metal or resin elements. The fastener element 30,40 can be attached to the fastener tape 10,20, in accordance with its type, through swaging, injection-molding, or sewing. Embodiment is also envisioned where the fastener element 30,40 is woven together in the structure of the fastener tape 10,20.

Rear stop 7 can be attached to cover the left and right fastener elements 30, 40. Front stop 8 can be attached to the fastener element 30. The front stop 9 can be attached to the fastener element 40. Note that the rear stop 7, the front stop 8, and the front stop 9 can be attached to cover not only the fastener element but also to cover at least a portion of the wall 14,28.

For example, the tape upper surface 11,21 may be positioned at an outer side of a garment to which the slide fastener 1 is sewn, and the tape lower surface 12,22 may be positioned at an inner side of the garment. It is however envisioned that this relationship is reversed. It is not possible to see if a cloth of garment is on a moving path of the slider 5 in the internal space of the garment. Therefore, that cloth is likely be jammed in the slider 5. Whereas, one does not necessarily take a close look at the slider 5 or its periphery when operating and moving the slider 5. That is, there is a possibility that a cloth of garment can be jammed in the slider 5 even in the outside of the garment. It is envisioned that a cloth of garment is more likely be jammed in the slider 5 if thinner cloth is used for the garment. The slide fastener 1 can be used for opening and closing not only for garments but also for tents or sleeping bags. The sleeping bag is configured by filling heat storage material inside pockets made of a thin cloth. It is envisioned that the slider 5 is operated by a hand only without being looked at, and thus the slide fastener 1 according to the present disclosure would be suitably used.

Distance between the rear stop 7 and the front stop 8,9 in the slide fastener 1 is defined as a movable range R5 (See FIG. 1) of the slider 5. In at least a part or the entirety of the movable range R5 of the slider 5, the slider upper portion 5A is positioned adjacent to the wall upper portion 14A,24A and the slider lower portion 5B is positioned adjacent to the wall lower portion 14B,24B, thus preventing jamming of a cloth in the slider 5 at both sides of the tape upper and lower surfaces 11,12,21,22. In particular, it is possible that the respective tape upper and lower surfaces are provided with a solid portion of the wall 14,24 which is necessary for ensuring a solidity of the wall 14,24. Therefore, it is possible to prevent jamming of a cloth in the slider 5 at both sides of the fastener tape 10,20 while suppressing a bulkiness of the wall 14,24. Note that, the movable range R5 of the slider 5 is, typically, a range between the rear stop 7 and the front stop 8,9, but one or both stop members can be omitted in some cases.

In some cases, a distance between the slider upper portion 5A and the wall 14 is in a range of 0-1 times the width of the fastener element 30,40 in the same direction as that distance (i.e. in the Left-Right direction); and/or a distance between the slider lower portion 5B and the wall 14 is in a range of 0-1 times the width of the fastener element 30,40 in the same direction as said distance (i.e. in the Left-Right direction). When the above-described width is at 0 times, the slider upper portion 5A and the wall 14 are in contact each another. The same applies to the relationship of the slider lower portion 5B and the wall 14.

The wall upper portion 14A,24A is arranged to touch the slider upper portion 5A and/or the wall lower portion 14B,24B is arranged to touch the slider lower portion 5B, not necessarily limited to this tough. In a flat condition shown in FIG. 1 where the slide fastener 1 is not bent or twisted, the wall 14,24 and the slider 5 are in contact each another. A cloth is more effectively prevented from being positioned frontward of the front opening 58A,58B of the slider 5, rearward of the rear opening 59 of the slider 5 and adjacent to the slit S1,S2 of the slider 5.

Further detail descriptions will follow on contact between the wall upper portion 14A,24A and the slider upper portion 5A and contact between the wall lower portion 14B,24B and the slider lower portion 5B. As shown in FIG. 2, it is preferable that the wall upper portion 14A,24A and at least a side surface of an end of the slider upper portion 5A at the side of the rear opening touch one another. It is preferable that the wall lower portion 14B,24B and at least a side surface of an end of the slider lower portion 5B at the side of the rear opening touch one another. Such arrangement would be particularly desirable for a case where jamming is envisioned when a slider is pulled rearward.

It is desirable that the wall upper portion 14A,24A and at least a side surface of an end of the slider upper portion 5A at the side of the front opening touch each other. It is desirable that the wall bottom portion 14B,24B and at least a side surface of an end of the slider lower portion 5B at the side of the front opening touch each other. Such arrangement would be particularly desirable for a case where jamming is envisioned when a slider is pulled frontward.

More preferably, the wall upper portion 14A,24A and a side surface of the slider upper portion 5A, extending substantially across the entire length between the front opening and the rear opening, are in contact as shown in FIG. 1. Preferably, the wall lower portion 14B,24B and a side surface of the slider lower portion 5B, extending substantially across the entire length between the front opening and the rear opening, are in contact.

Also, in a case where a surface of the wall upper portion 14A,24A is round, it is preferable that a corner of a flange of the slider upper portion 5A is kept touching the round surface of the wall upper portion 14A,24A as shown in FIG. 2. In a case where a surface of the wall lower portion 14B,24B is round, it is desirable that a corner of a flange of the slider upper portion 5A is kept touching the round surface of the wall lower portion 14B,24B.

The above-described manners of contact can be distinguishable recognized as a respective independent inventive concept, and combinations thereof would also be distinguishably recognized as different inventive concepts.

As shown in FIG. 6, the front end of the upper wing 51 has left and right shoulders 51*p*,51*q* extending in the Left-Right direction and a central recess 51*r* recessed rearward at a position between the left and right shoulders 51*p*,51*q*. Likewise, the front end of the lower wing 52 has left and right shoulders 52*p*,52*q* extending in the Left-Right direction and a central recess 52*r* recessed rearward at a position between the left and right shoulders 52*p*,52*q*. According to such a configuration, even if a cloth is positioned in front of the slider 5, the cloth may be guided into the central recess 51*r*,52*r* when the slider 5 moves frontward, and thus it may less likely be jammed in the slider 5. That is, it may be possible to reduce a risk that a cloth is caught in a space between the slider and the periphery of the fastener element. Preferably, the left or right shoulder is a linear portion that extends linearly in the Left-Right direction.

As a further option, the front end of the flange 56*p*,56*q* is coupled to the front end of the upper wing 51. In cases where left and right walls 14, 24 are arranged as described below, a possibility is low that a cloth traverses the wall 14,24 to reach the flange 56*p*,56*q* and is nipped between the flange 56*p*,56*q* and the fastener element 30,40. The descriptions made for the upper wing 51 holds true for the lower wing 52, and thus overlapping description is omitted.

The flange 56*p*,56*q* has a flange rear portion 56*p*1,56*q*1 and a flange sloped portion 56*p*2,56*q*2 arranged frontward of the flange rear portion 56*p*1,56*q*1. The flange rear portion 56*p*1,56*q*1 extend in parallel to the movement direction of the slider 5. The interspace between the flange rear portions 56*p*1,56*q*1 is constant along the Front-Rear direction. The flange sloped portion 56$p$2,56$q$2 extends obliquely frontward from the flange rear portion 56$p$1,56$q$1. The interspace between the flange sloped portions 56$p$2,56$q$2 increases frontward. In some cases, an angle between the flange rear portion 56$p$1,56$q$1 and the flange sloped portion 56$p$2,56$q$2 is in a range between 15° to 35°.

The fastener tapes 10,20 are respectively provided with the walls 14,24, thus preventing a cloth from moving in a direction toward the central line AX of the slide fastener 1 in the Left-Right direction shown in FIG. 1 (see the arrows). However, this case cannot cope with a case where a cloth is positioned in front of the slider 5 between the fastener elements 30,40. As described above, the front end of the slider 5 is provided with the central recess 51$r$,52$r$ and, when the slider 5 moves frontward, a cloth in front of the slider 5 is guided into the central recess 51$r$,52$r$, thus preventing a cloth from entering into a space between the slider 5 and the fastener element, i.e. jamming of a cloth in the slider 5 is prevented.

Other than a case where the walls 14,24 are integrally formed with the fastener tape 10,20 as shown in FIG. 2, it may be configured by attaching a separate part to the fastener tape 10,20. For example, it may be possible that a first core thread is sewn onto the tape upper surface and a second core thread is sewn onto the tape lower surface so that a wall protruding in the Up-Down direction is formed. Even in such an arrangement, it is possible that the respective tape upper and lower surfaces are provided with a solid portion of the wall 14,24 which is necessary for ensuring a solidity of the wall 14,24. Therefore, jamming of a cloth in the slider 5 can be prevented at both sides of the fastener tape 10,20 while suppressing a bulkiness of the wall.

FIG. 8 illustrates that the wall 14,24 is divided into plural islands 14$i$,24$i$. Even in such a case, similar effects would be achieved as the above-described embodiments. Each island 14$i$,24$i$ is elongated in the Front-Rear direction, but should not be limited to this shape. The islands 14$i$,24$i$ can be attached to the fastener tape 10,20 through swaging, injection molding, sewing and so on likewise the fastener element 30,40. Similar to the above-described cases, each island 14$i$,24$i$ may have a tubular structure 15,25 and a core 16,26 enclosed in this tubular structure 15,25. Needless to say, it is possible to employ metal-made or resin-made islands.

FIG. 9 shows an embodiment where the walls 14,24 are resin or metal parts and attached to the fastener tape 10,20 through injection molding or swaging. Material of the wall 14,24 would be various and a use of core such as a cord is not mandatory.

FIG. 10 shows an embodiment where the slider 5 is configured by a slider body 5$j$ and a cover 5$u$ attached thereto. The cover 5$u$ is a retrofit component attached to the slider body 5$j$ to prevent jamming of a cloth in the slider body 5$j$. The cover 5$u$ is configured to prevent jamming of a cloth in the slider 5 when the slider 5 moves frontward (see FIG. 10) and/or to prevent jamming of a cloth in the slider 5 when the slider 5 moves rearward. The cover 5$u$ is constructed, for example, from a cover upper portion covering the slider upper portion 5A of the slider body 5$j$ from above, a cover lower portion covering the slider lower portion 5B of the slider body 5$j$ from below, and a connecting portion interconnecting the cover upper portion and the cover lower portion. The cover top and lower portions are coupled by a method such as a mechanical fit in the connecting portion such that the slider body 5$j$ is accommodated in the slider body 5$j$. Note that the cover upper portion is a part of the slider upper portion 5A arranged at the same side as the tape upper surface 11,21. The cover lower portion is a part of the slider lower portion 5B arranged at the same side as the tape lower surface 12,22. The connecting portion interconnecting the cover upper portion and the cover lower portion is a part of the connecting portion 5C interconnecting the slider upper portion 5A and the slider lower portion 5B.

In the case shown in FIG. 10, the cover 5$u$ is configured to define a space for holding the slider body 5$j$, a left passage 81A for the left fastener element, and a right passage 81B for the right fastener element. The left passage 81A is in spatial communication with a left passage 71A at the left side of the connecting post 53 of the slider body 5$j$. The right passage 81B is in spatial communication with a right passage 71B at the right side of the connecting post 53 of the slider body 5$j$. Note that the left and right passages 71A,71B in the slider body 5$j$ are in communication with a passage 71C provided rearward of the connecting post 53 of the slider body 5$j$. Such a cover 5$u$ has been known for a skilled person as disclosed in International Publication No. 2016/035125 (which is incorporated herein by reference), and thus detail descriptions will be omitted.

The slider body 5$j$ is not a special/dedicated slider shown in FIGS. 3-6, but is a commonly used slider. In the present embodiment, likewise the above-described embodiments, in at least a part of or in the entirety of the movable range R5 of the slider 5 (FIG. 1), the upper portion of the slider 5 (i.e. the upper portion of the cover 5$u$ of the slider 5) is positioned adjacent to (e.g. touches) the upper portion of the wall 14,24 and the lower portion of the slider 5 (i.e. the lower portion of the cover 5$u$ of the slider 5) is positioned adjacent to (e.g. touches) the lower portion of the wall 14,24 so that jamming of a cloth in the slider 5 is prevented at both sides of the tape upper and lower surfaces. Therefore, similar effects as the above-described embodiments can be obtained in the present embodiment either.

Based on the above teachings, a skilled person in the art would be able to add various modifications to the respective embodiments. Reference numbers in Claims are just for reference and should not be referred for a purpose of narrowly construing the scope of claims. Use of the special/dedicated slider shown in FIGS. 3-6 is not mandatory. The wall 14,24 should not be limited to an arrangement where it extends linearly, but the wall 14,24 may meander or extend in zigzag.

REFERENCE NUMERALS

1 Slide fastener
2 Fastener stringer
4 Fastener stringer
5 Slider
10 Fastener tape
14 Wall
14A Wall upper portion
14B Wall lower portion
20 Fastener tape
24 Wall
24A Wall upper portion
24B Wall lower portion
30 Fastener element
40 Fastener element That which is claimed is:

1. A slide fastener comprising:

a pair of fastener stringers including a fastener tape and a fastener element arranged on a side-edge of the fastener tape, the fastener tape having tape upper and lower surfaces defining a tape thickness; and a slider to be moved to open or close the pair of fastener stringers, the slider including a slider upper portion arranged at a same side as the tape upper surface, a slider lower portion arranged at a same side as the tape lower surface, and a connecting portion connecting the slider upper portion and the slider lower portion, wherein:

at least one fastener tape is provided with a flexible wall configured to prevent jamming of a cloth, the flexible wall being arranged to be spaced apart from the fastener element, the flexible wall including a tubular structure of the fastener tape and a core enclosed in the tubular structure, the tubular structure including warp threads, the warp threads including a warp thread having a thickness greater than a thickness of a weft thread in the fastener tape, the flexible wall includes a wall upper portion arranged at the same side as the tape upper surface and protruding from the tape upper surface, and a wall lower portion arranged at the same side as the tape lower surface and protruding from the tape lower surface, and in at least a part of a movable range of the slider, the slider upper portion is positioned adjacent to the wall upper portion and the slider lower portion is positioned adjacent to the wall lower portion, the slide fastener being configured to prevent jamming of a cloth in the slider at both sides of the tape upper and lower surfaces.

2. The slide fastener of claim 1, wherein the wall upper portion is arranged to touch the slider upper portion at least partially.

3. The slide fastener of claim 2, wherein the wall lower portion is arranged to touch the slider lower portion at least partially.

4. The slide fastener of claim 1, wherein a distance between the slider upper portion and the flexible wall is equal to or less than a width of the fastener element in a same direction as the distance; and/or a distance between the slider lower portion and the flexible wall is equal to or less than a width of the fastener element in a same direction as the distance between the slider lower portion and the flexible wall.

5. The slide fastener of claim 1, wherein:

the slider has a slit for passing the fastener tape, the slit being defined between opposed portions of the slider upper portion and the slider lower portion, and a thickness of the flexible wall in an Up-Down direction is in a range between 0.75 times and 5 times a width of the slit in the Up-Down direction.

6. The slide fastener of claim 5, wherein the thickness of the flexible wall in the Up-Down direction is in a range between 1 times and 5 times the width of the slit in the Up-Down direction.

7. The slide fastener of claim 1, wherein:

the slider includes a slider body including an upper wing, a lower wing, and a connecting post connecting the upper wing and the lower wing, the upper and lower wings being arranged to face one another, each of the upper wing and the lower wing has a front end in which left and right shoulders extend along a Left-Right direction and a central recess is recessed rearward at a position between the left and right shoulders, the Left-Right direction being orthogonal to a movement direction of the slider body.

8. The slide fastener of claim 7, wherein the upper wing has a flange protruding toward the lower wing to define a slit for passing the fastener tape, and a front end of the flange is connected to the front end of the upper wing.

9. The slide fastener of claim 1, wherein the wall upper portion and at least a side surface of a rear end of the slider upper portion touch one another.

10. The slide fastener of claim 9, wherein the wall lower portion and at least a side surface of a rear end of the slider lower portion touch one another.

11. The slide fastener of claim 1, wherein the wall lower portion and at least a side surface of a rear end of the slider lower portion touch one another.

12. The slide fastener of claim 1, wherein the wall lower portion is arranged to touch the slider lower portion at least partially.

13. The slide fastener of claim 1, wherein a first interspace in a weft direction between the warp threads in the tubular structure is greater than a second interspace in the weft direction between warp threads located in another part of the fastener tape excluding the tubular structure.

14. The slide fastener of claim 1, wherein the thickness of the warp thread of the tubular structure is equal to or greater than 3 times the thickness of the weft thread in the fastener tape.

15. A slide fastener comprising:

a pair of fastener stringers including a fastener tape and a fastener element arranged on a side-edge of the fastener tape, the fastener tape having tape upper and lower surfaces defining a tape thickness; and a slider to be moved to open or close the pair of fastener stringers, the slider including a slider upper portion arranged at a same side as the tape upper surface, a slider lower portion arranged at a same side as the tape lower surface, and a connecting portion connecting the slider upper portion and the slider lower portion, wherein:

at least one fastener tape is provided with a flexible wall configured to prevent jamming of a cloth, the flexible wall being arranged to be spaced apart from the fastener element, the flexible wall including a tubular structure of the fastener tape and a core enclosed in the tubular structure, the core including a plurality of threads, the flexible wall includes a wall upper portion arranged at the same side as the tape upper surface and protruding from the tape upper surface, and a wall lower portion arranged at the same side as the tape lower surface and protruding from the tape lower surface, and, in at least a part of a movable range of the slider, the slider upper portion is positioned adjacent to the wall upper portion and the slider lower portion is positioned adjacent to the wall lower portion, the slide fastener being configured to prevent jamming of a cloth in the slider at both sides of the tape upper and lower surfaces.

16. The slide fastener of claim 15, wherein the core includes a bundle of threads.

17. A slide fastener comprising:

a pair of fastener stringers including a fastener tape and a fastener element arranged on a side-edge of the fastener tape, the fastener tape having tape upper and lower surfaces defining a tape thickness; and a slider to be moved to open or close the pair of fastener stringers, the slider including a slider upper portion arranged at a same side as the tape upper surface, a slider lower portion arranged at a same side as the tape lower surface, and a connecting portion connecting the slider upper portion and the slider lower portion, wherein:

at least one fastener tape is provided with a flexible wall configured to prevent jamming of a cloth, the flexible wall being arranged to be spaced apart from the fastener element, the flexible wall including a tubular structure of the fastener tape and a core enclosed in the tubular structure, the tubular structure comprising warp threads and a weft thread, the flexible wall includes a wall upper portion arranged at the same side as the tape upper surface and protruding from the tape upper surface, and a wall lower portion arranged at the same side as the tape lower surface and protruding from the tape lower surface, and, in at least a part of a movable range of the slider, the slider upper portion is positioned adjacent to the wall upper portion and the slider lower portion is positioned adjacent to the wall lower portion, the slide fastener being configured to prevent jamming of a cloth in the slider at both sides of the tape upper and lower surfaces.

18. The slide fastener of claim 17, wherein a first interspace in a weft direction between the warp threads in the tubular structure is greater than a second interspace in the weft direction between warp threads located in another part of the fastener tape excluding the tubular structure.

19. The slide fastener of claim 17, wherein a thickness of the warp thread of the tubular structure is equal to or greater than 3 times a thickness of the weft thread in the fastener tape.

* * * * *